US005205085A

United States Patent [19]

Urakami

[11] Patent Number: 5,205,085

[45] Date of Patent: Apr. 27, 1993

[54] CENTRIFUGAL BLASTING APPARATUS

[76] Inventor: Fukashi Urakami, Maruyoshi Bldg. 608, 4-17-24, Kohnandai, Kohnan-ku, Yokohama, 233, Japan

[21] Appl. No.: 886,575

[22] Filed: May 21, 1992

[51] Int. Cl.[5] ..... B24C 9/00; B24C 5/06; B24C 7/00

[52] U.S. Cl. ..... 51/433; 51/424

[58] Field of Search ..... 51/410, 424, 425, 426, 51/431, 432, 433, 434, 435, 436, 317, 319; 239/302, 310; 222/152, 205, 335

[56] References Cited

U.S. PATENT DOCUMENTS

| | | | |
|---|---|---|---|
| 2,590,576 | 3/1952 | Rosenberger et al. | 51/435 |
| 2,789,804 | 4/1957 | Toulmin, Jr. | 51/434 |
| 3,277,608 | 10/1966 | Fahrney | 51/434 |
| 4,064,656 | 12/1977 | Zeidler | 51/431 |
| 4,563,841 | 1/1986 | Hart et al. | 51/434 |
| 4,565,035 | 1/1986 | Carpenter, Jr. et al. | 51/434 |
| 4,646,483 | 3/1987 | Mangan | 51/435 |
| 4,759,156 | 7/1988 | Baumgart | 51/434 |
| 4,984,396 | 1/1991 | Urakami | 51/424 |
| 4,993,200 | 2/1991 | Morioka et al. | 51/424 |
| 5,024,028 | 6/1991 | Pierce et al. | 51/432 |
| 5,081,801 | 1/1992 | Fylak | 51/435 |

*Primary Examiner*—Bruce M. Kisliuk
*Assistant Examiner*—Bryan Reichenbach
*Attorney, Agent, or Firm*—Nikaido, Marmelstein, Murray & Oram

[57] ABSTRACT

Disclosed is an improved centrifugal blasting apparatus for the blast cleaning or shot peening treatment of a selected surface of an object to be treated by throwing pulverized abrasive material onto the surface. Its wheel casing has an elongated slot to permit pulverized abrasive material to pass therethrough and scatter through the air with centrifugal force, which is given by the blades of the rotary blade wheel. The inlet suction conduit extends from the blasting cabinet to the wheel casing, and the outlet suction conduit extends from the wheel casing to an associated vacuum pump. The abrasive material storage or collector is provided in the inlet suction conduit, thus making up an abrasive material circulating loop. The apparatus uses no force of gravity to supply pulverized abrasive material to its rotary blade wheel, and therefore, the positioning of the rotary blade wheel is not limited with regard to availableness of the force of gravity. It requires neither air-tight ejector nor screw conveyers or bucket elevators, and accordingly its weight and size can be reduced substantially.

13 Claims, 7 Drawing Sheets

CENTRIFUGAL BLASTING APPARATUS

BACKGROUND OF THE INVENTION

1. Field of the Invention

The present invention relates to a centrifugal blasting apparatus for blast cleaning or shot peening treatment of a selected surface of an object to be treated by throwing, with centrifugal force, pulverized abrasive material such as steel particles onto the surface.

2. Description of Related Art

A conventional centrifugal blasting apparatus is designed to use the force of gravity to supply pulverized material to its blade wheel, as disclosed in Japanese Patent 51-14314(B1) (corresponding to U.S. Patent application Ser. No. 703,397 filed on Feb. 5, 1969 in the name of James W. Forgel) and U.S. Pat. No. 3,788,010.

Another conventional centrifugal blasting apparatus is designed to separate pulverized abrasive material from the stream of airborne pulverized abrasive material and supply the so separated abrasive material to the blade wheel as disclosed in U.S. Pat. No. 4,095,378. This type of centrifugal blasting apparatus requires an abrasive material collector and an air-tight abrasive material ejector, which is connected to the outlet of the abrasive material collector.

The former centrifugal blasting apparatus cannot work if it is put in such a position that pulverized abrasive material cannot fall on its blade wheel by the force of gravity. Thus, the positioning of the apparatus is limited.

The latter centrifugal blasting apparatus is required to operate under the conditions that the inner pressure of the abrasive material collector is substantially lower than the surrounding atmosphere (for instance, by 50 mm Hg), and that it is difficult to reduce the size of the air-tight abrasive material ejector.

SUMMARY OF THE INVENTION

One object of the present invention is to provide a centrifugal blasting apparatus which can be used in much less limited positions than the former conventional blasting apparatus, and at least its rotary blade wheel can work no matter which position it may be put.

Another object of the present invention is to provide a centrifugal blasting apparatus which requires no air-tight abrasive material ejector in spite of separating pulverized abrasive material from the stream of airborne pulverized abrasive material and supplying the so separated abrasive material to the blade wheel.

Still another object of the present invention is to provide a small-sized centrifugal blasting apparatus in which pulverized abrasive material is collected after being thrown from the rotary blade wheel; the so collected pulverized abrasive material is permitted to ride on a stream of air; pulverized abrasive material is separated from the stream of airborne pulverized abrasive material; and the so separated abrasive material is fed back to the blade wheel.

To attain these objects a centrifugal blasting apparatus according to the present invention comprises a rotary blade wheel, a wheel casing to enclose the rotary blade wheel, the wheel casing having an elongated slot to permit pulverized abrasive material to pass therethrough and scatter through the air with centrifugal force, an inlet suction conduit connected at its downstream end to the wheel casing to permit transportation of airborne pulverized abrasive material from its upperstream suction end to the inside of the rotary blade wheel, and an outlet suction conduit connected at its upperstream end to the wheel casing and at its downstream end to suction means such as a vacuum pump to draw air from the inside of the wheel casing. This arrangement makes it unnecessary to place a gravity type abrasive material feeder in the form of a collector and a gravity type abrasive material transporter in the form of ejectors (both using the force of gravity to perform the required operations) just before and after an associated rotary blade wheel respectively operates.

According to one embodiment of the present invention the downstream end of the inlet suction conduit may be positioned at the center of the rotary blade wheel, and may be provided with an opening at its side in the vicinity of the blade roots, which are fixed to the hub plate of the rotary blade wheel. The rotary blade wheel may have a plurality of blades on its hub, each blade radially extending and outward converging in width. The hub plate of the rotary blade wheel may be integrally connected to the axle of the rotary blade wheel to extend radially and incline down outward, thus forming a frusto conical surface, and the outward converging blades may be integrally connected to the frusto conical hub plate. Each blade may comprise an outward converging vertical piece integrally connected on its upper edge to the frusto conical hub plate and an outward rising sector piece integrally connected to the lower edge of the vertical piece and extending perpendicular thereto. The sector piece may come closer to the hub plate in radial directions.

The centrifugal blasting apparatus may further comprise a blasting cabinet having an opening to be directed to an selected surface of an object to be treated by blasting, and being integrally connected to the wheel casing with the elongated slot of the wheel casing being directed to the opening of the blasting cabinet, and the upperstream end of the inlet suction conduit being connected to the blasting cabinet to communicate with its inner space.

The centrifugal blasting apparatus may further comprise an abrasive material storage connected to the bottom of the blasting cabinet and to the inlet suction conduit intermediate between its upstream and downstream ends. The abrasive material storage may have a flow control valve to control the flow rate of pulverized abrasive material from the storage.

According to another embodiment of the present invention the centrifugal blasting apparatus may comprise an abrasive material collector connected across a selected intermediate length of the inlet suction conduit. The upperstream length of the inlet suction conduit may be connected at its upperstream end to the blasting cabinet, and at its downstream end to the top of the abrasive material collector; the intermediate length of the inlet suction conduit may be connected at its upperstream end to the top of the abrasive material collector, and at its downstream end to the bottom of the abrasive material collector; and the downstream length of the inlet suction conduit may be connected at its upperstream end to the bottom of the abrasive material collector, and at its downstream end to the bottom of the wheel casing. The abrasive material collector may have a flow control valve to control the flow rate of pulverized abrasive material flowing down from the collector. The blasting cabinet may have seal means around its opening to prevent the scattering of pulverized abrasive material from the blasting cabinet.

The blasting cabinet may have means to permit transportation of the blasting cabinet on a selected surface of an object to be treated by blasting.

Other objects and advantages of the present invention will be understood from centrifugal blasting apparatuses according to preferred embodiments of the present invention, which are shown in accompanying drawings.

DESCRIPTION OF THE PREFERRED EMBODIMENTS

Figure 1:
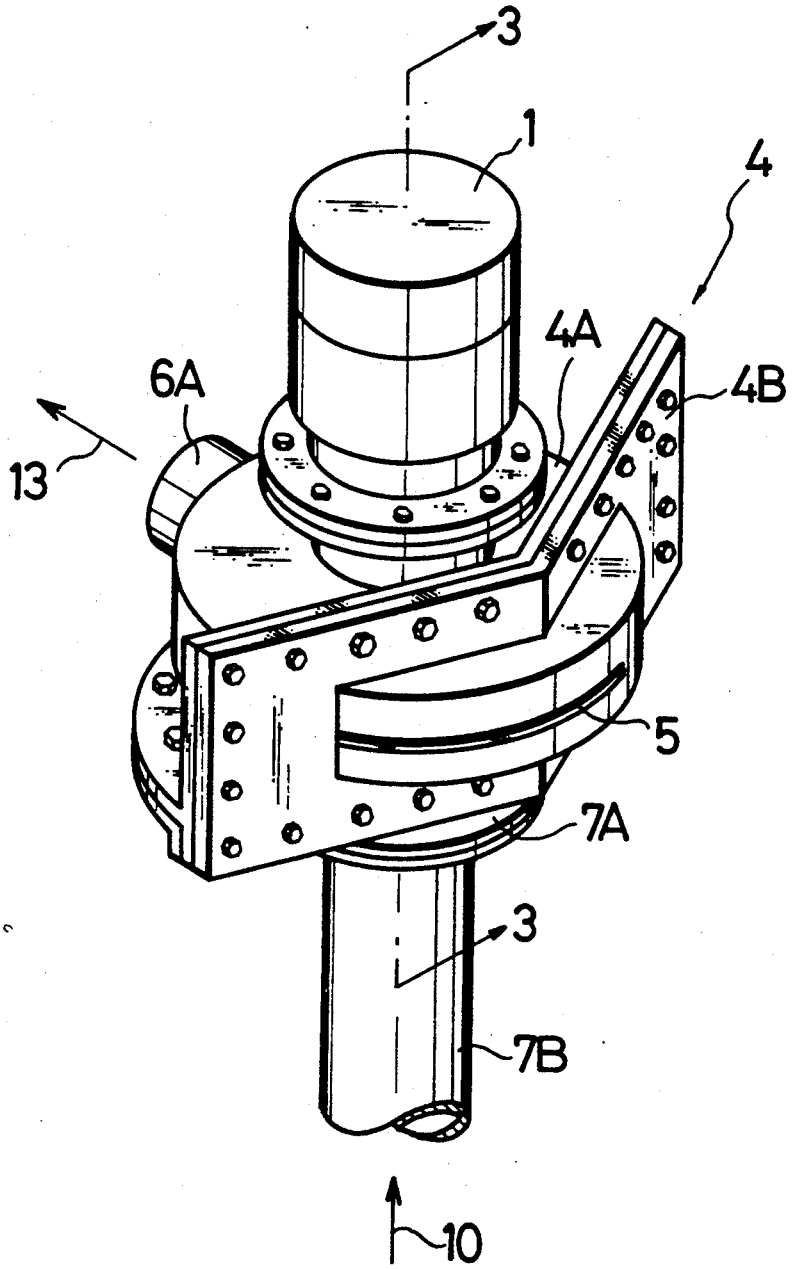
FIG. 1 is a perspective view of a blasting head according to the present invention.
Figure 2:
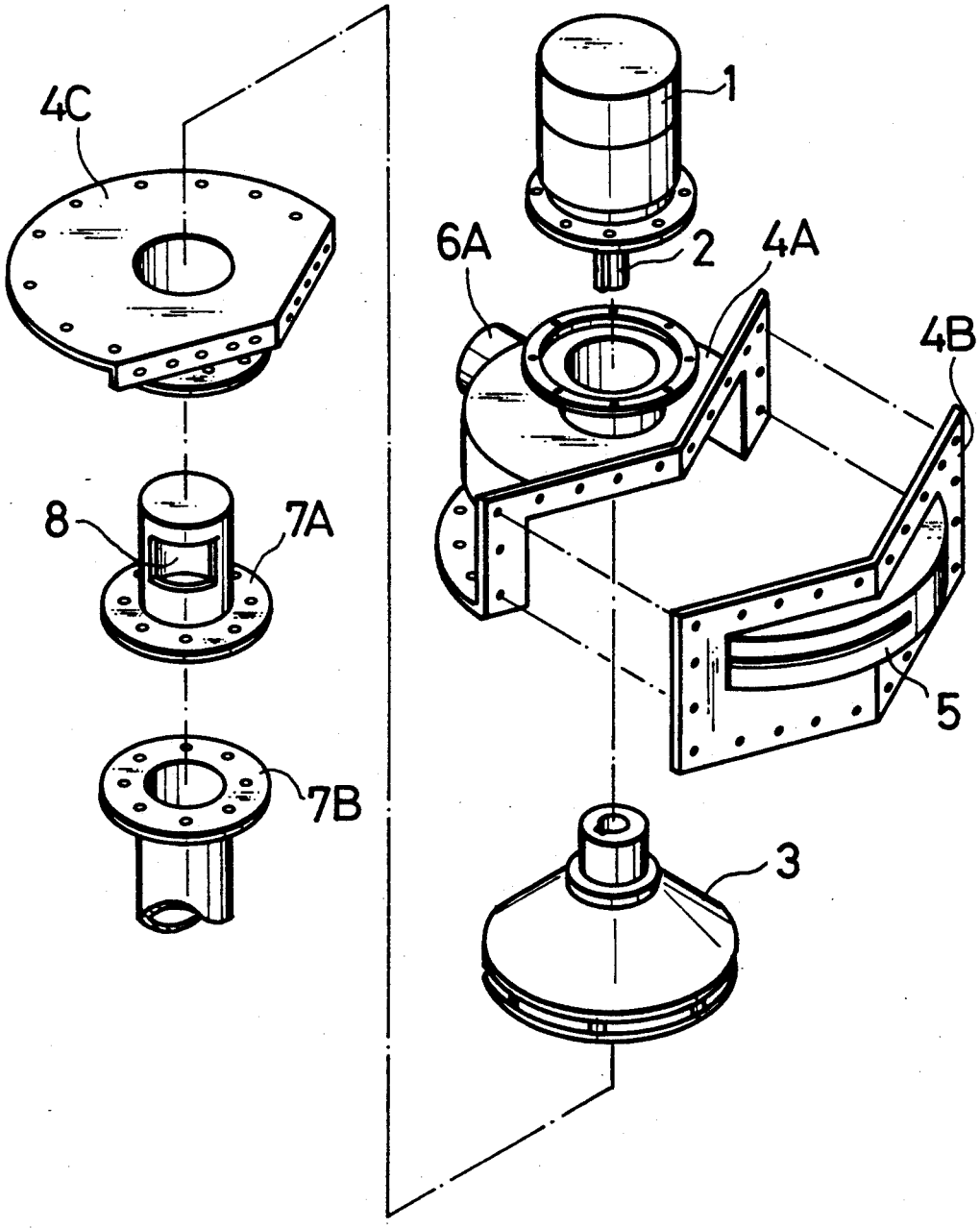
FIG. 2 is an exploded view of the blasting head of FIG. 1.

Referring to FIGS. 1 to 4, a blasting head for a centrifugal blasting apparatus according to the present invention is shown as comprising a rotary blade wheel 3 connected to the shaft 2 of an associated electric motor 1, a wheel casing 4 consisting of upper, lower and lateral sections 4A, 4C and 4B to enclose the rotary blade wheel 3, and an inlet suction conduit 7A and 7B connected at its downstream end 7A to the wheel casing 4 to permit transportation of airborne pulverized abrasive material from its upperstream suction end (not shown) to the inside of the rotary blade wheel 3, and an outlet suction conduit connected at its upperstream end 6A to the wheel casing 3 and at its downstream end to suction means such as vacuum pump (not shown) to draw air from the inside of the wheel casing 3. The electric motor 1 is mounted to the upper section 4A.

The lateral section 4B of the wheel casing 4 has an elongated slot 5 to permit pulverized abrasive material to pass therethrough and scatter through the air with centrifugal force, as described later. As best seen from FIGS. 3 and 4, the rotary blade wheel 3 may have a plurality of blades 32 on its hub 31. Each blade 32 radially extends and converges in width. The hub plate 31 of the rotary blade wheel 3 is integrally connected to the axle of the rotary blade wheel 3 to extend radially and incline down outward, thus forming a frusto conical surface. The outward converging blades 32 are integrally connected to the frusto conical hub plate 31. Each blade 32 comprises an outward converging vertical piece integrally connected along its upper edge to the frusto conical hub plate 31 and an outward rising or inclined sector piece 33 integrally connected to the lower edge of the vertical piece and extending perpendicular thereto. Each outward rising or inclined sector piece 33 comes closer to the hub plate 31 in radial directions, thus delimiting an outward converging compartment, tapering toward the elongated slot 5 of the lateral section 4B of the wheel casing 4. Also, as best seen from FIG. 4, each sector piece has an opening 34. FIG. 5 shows another rotary blade wheel as comprising a plurality of blades 32 on its hub 31. Each blade 32 radially converges, and has an outward rising or inclined strip 33 integrally connected to its lower edge.

In operation the inner space of the wheel casing 4 remains at a pressure which is somewhat lower than the surrounding atmosphere, thus causing a stream of air flowing into the inner space of the wheel casing 4 through the slot 5 of the wheel casing 4. The amount of air drawn from the inlet suction conduit 7A and 7B will increase inversely with the counter air stream, and accordingly the amount of pulverized abrasive material and hence, the blasting efficiency will increase inversely with the counter air stream. In this connection the slot space 5 of the wheel casing 4 is advantageously reduced to a possible minimum. The blasting efficiency will increase with increase of the angle $\alpha$ over which pulverized abrasive material can be thrown and spreaded. For these reasons the slot 5 of the wheel casing 4 must be reduced to limit in width, and at the same time, must be increased in length. For example, the slot diemensions may be determined so that the ratio of the air flow passing through slot 5 to the air flow injected from inlet suction conduit 7 is approximately 1 to 10.

The downstream end 7A of the inlet suction conduit is positioned at the center of the rotary blade wheel 3, and is provided with an opening 8 at its side in the vicinity of the blade roots on the hub plate 31 of the rotary blade wheel 3. The upperstream end of the inlet suction conduit draws airborne pulverized abrasive material, as described later in detail.

In an attempt to reduce the dynamic pressure loss to possible minimum the area of the opening 8 is determined to be substantially equal to the cross area of the inlet suction conduit. Specifically the circumferential length of the opening 8 can be determined from the practical limit of the throwing-and-spreading angle $\alpha$. Once the circumferential length of the opening 8 has been determined as such, the axial length of the opening 8 can be determined so as to make the opening space 8 substantially equal to the cross area of the inlet suction conduit. As a consequence the axial size of the opening 8 will be substantially large.

As for the blade shape appropriate for catching and throwing pulverized abrasive material with centrifugal force to pass through the elongated slot 5 of the wheel casing 4 the blade is tapered toward the circumferential slot 5 of the wheel casing 4. As an alternative the slotted side of the wheel casing 4 is made of a relatively thick board, and the circumferential slot 5 is made in the thickness of the board so as to become gradually narrower towards the outer circumference of the wheel casing 4. The tapering slot will have the effect of controlling pulverized abrasive material in flying direction while travelling and striking against the inner surface of the tapering slot even if the blades are given no tapering shape.

Figure 6:
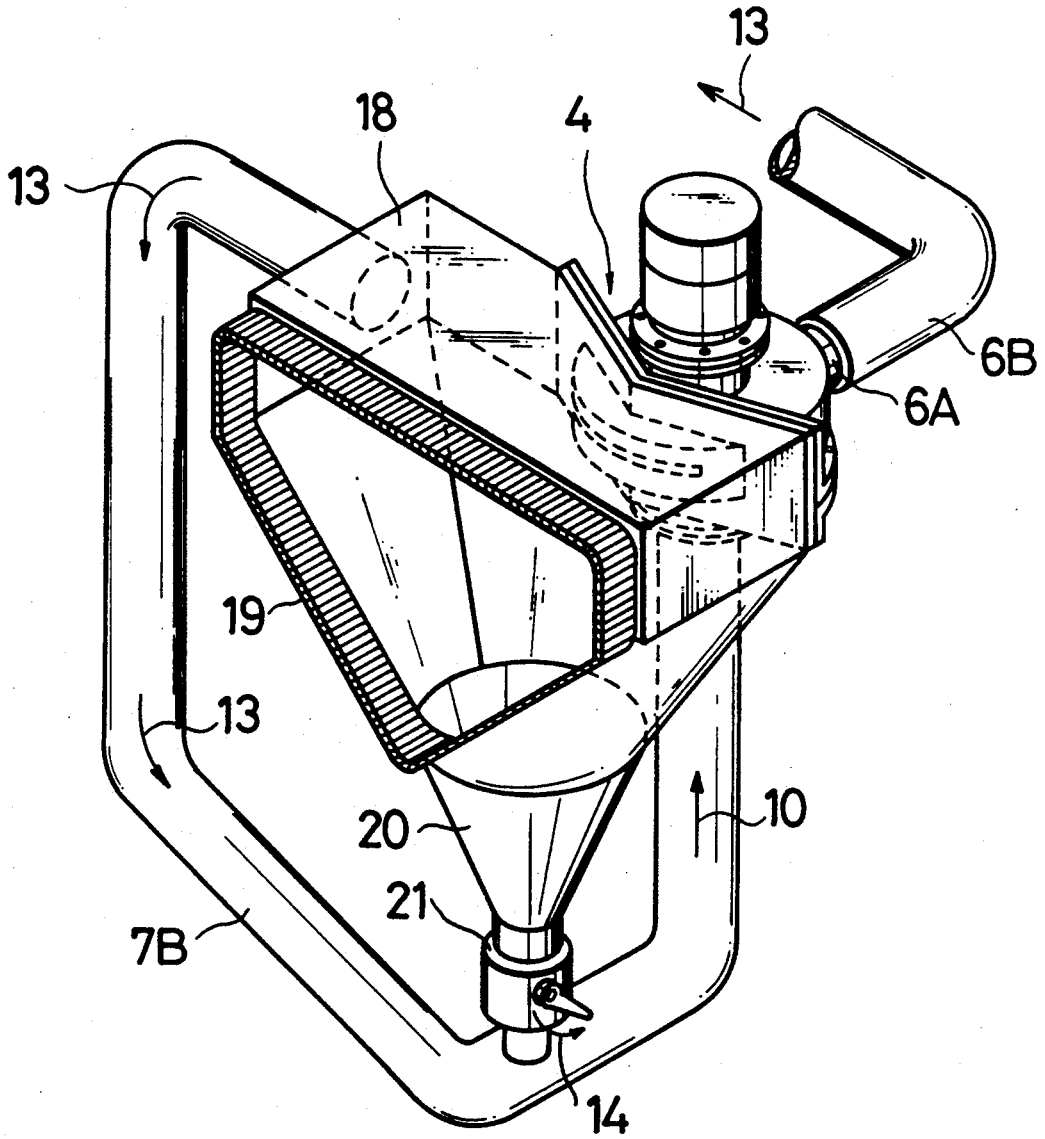
FIG. 6 is a centrifugal blasting apparatus according to one embodiment of the present invention.

Referring to FIG. 6, a centrifugal blasting apparatus according to one embodiment of the present invention includes a blasting cabinet 18 having an opening to be directed to a selected surface of an object to be treated by blasting. The wheel casing 4 is integrally connected to the blasting cabinet 18 with the elongated slot 5 of the wheel casing 4 directed to the opening of the blasting cabinet 18. The upperstream end of the inlet suction conduit 7B is connected to the blasting cabinet 18 to communicate with its inner space. The centrifugal blasting apparatus includes an abrasive material storage 20 connected to the bottom of the blasting cabinet 18 and to the inlet suction conduit 7B intermediate between its upstream and downstream ends. The abrasive material storage 20 has a flow control valve 21 to control the flow rate of pulverized abrasive material flowing down from the storage 20. The blasting cabinet 18 has seal means 19 around its opening to prevent the scattering of pulverized abrasive material from the blasting cabinet 18.

Figure 7:
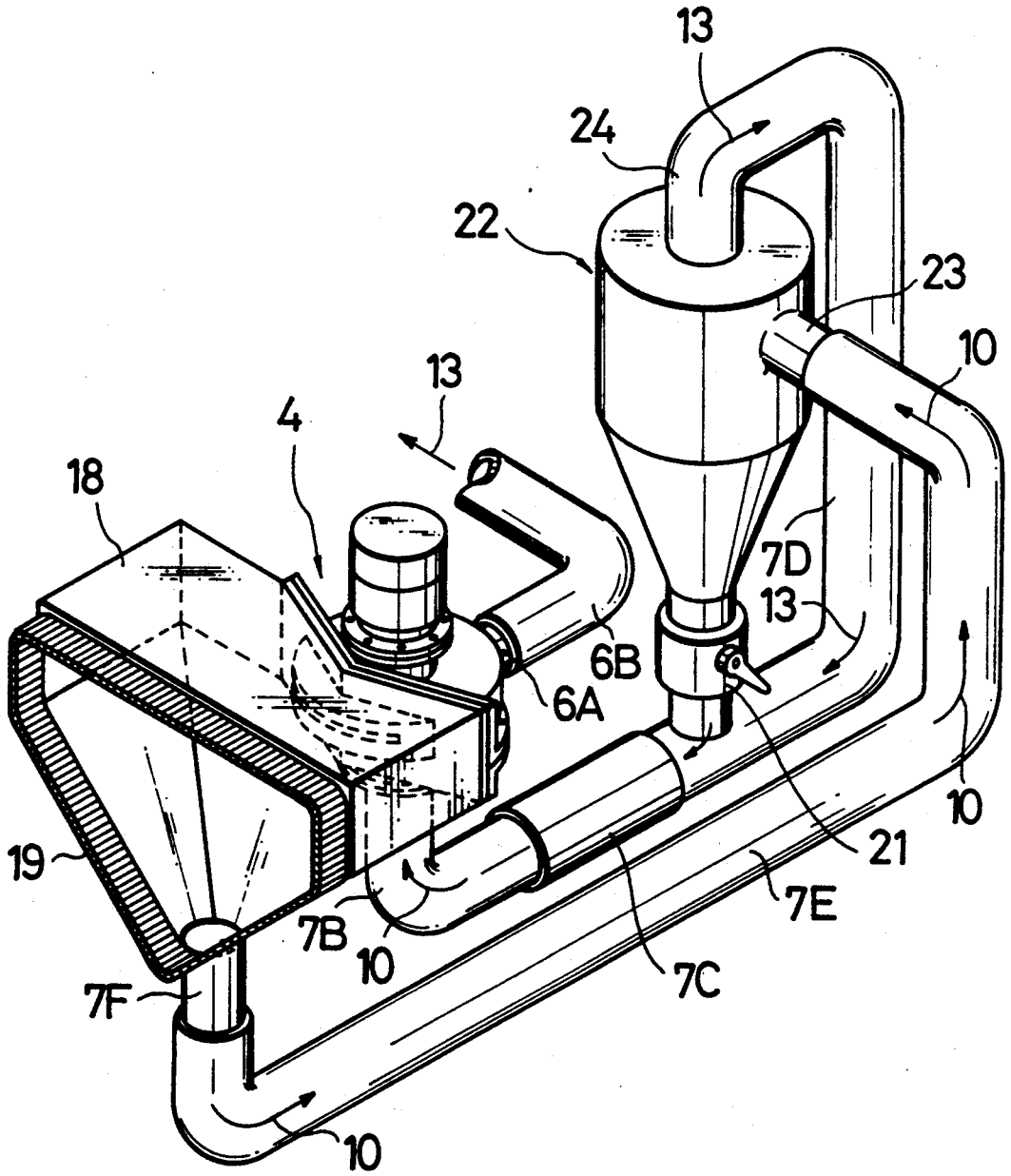
FIG. 7 is a centrifugal blasting apparatus according to another embodiment of the present invention.

Referring to FIG. 7, a centrifugal blasting apparatus according to another embodiment of the present invention includes an abrasive material collector 22 connected across a selected intermediate length 7D of the inlet suction conduit. The abrasive material collector 22 has a flow control valve 21 to control the flow rate of pulverized abrasive material flowing down from the collector 22. The upperstream length 7E of the inlet suction conduit is connected at its upperstream end to the blasting cabinet 18, and at its downstream end to the top of the abrasive material collector 22. The intermediate length 7D of the inlet suction conduit is connected at its upperstream end to the top of the abrasive material collector 22, and at its downstream end to the bottom or flow control valve 21 of the abrasive material collector 22. Finally, the downstream length 7C and 7B of the inlet suction conduit is connected at its upperstream end to the bottom or flow control valve 21 of the abrasive material collector 22, and at its downstream end to the bottom of the wheel casing 4.

Figure 3:
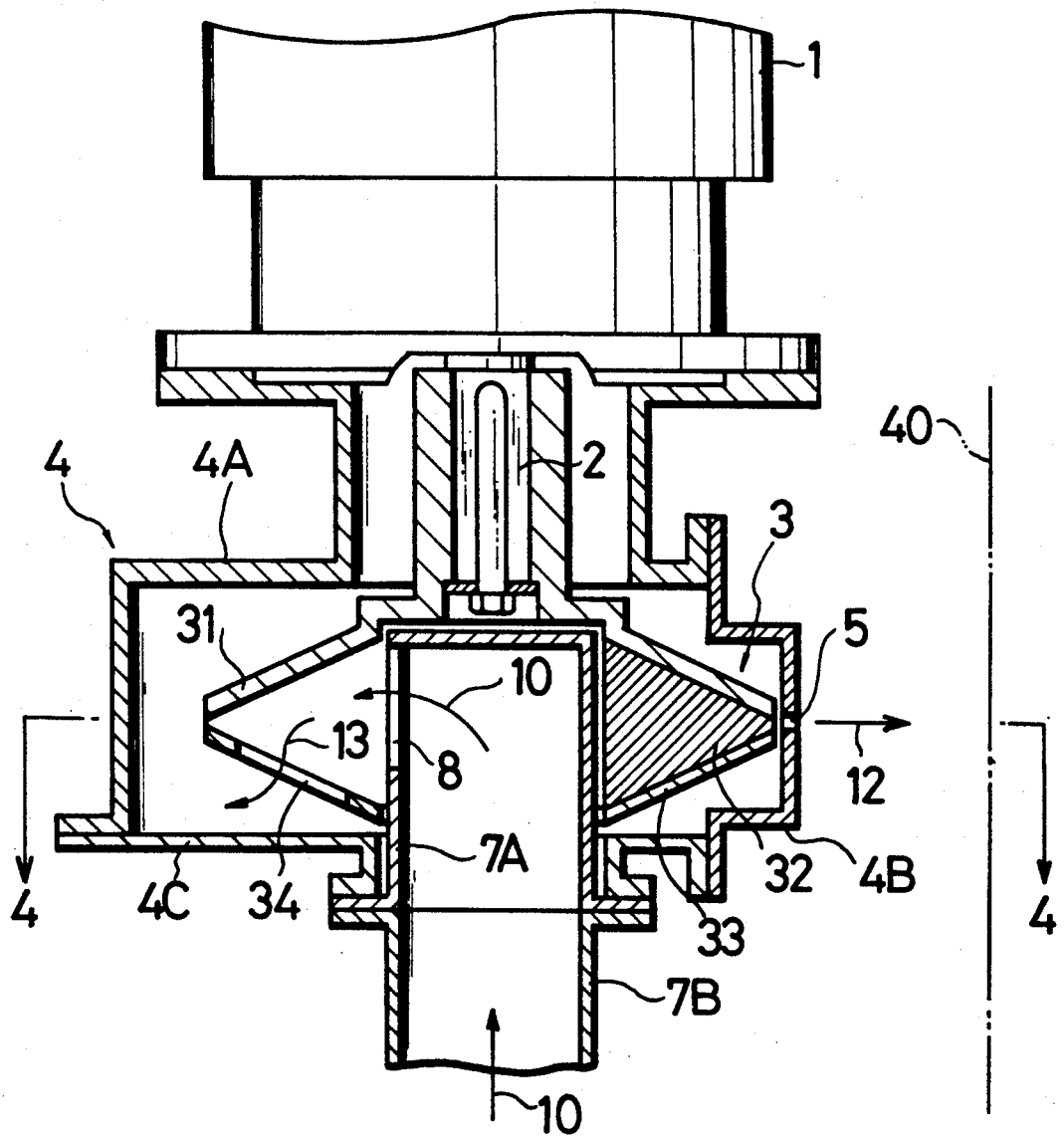
FIG. 3 is a longitudinal section of the blasting head of FIG. 1 taken along the line 3—3 in FIG. 1.
Figure 4:
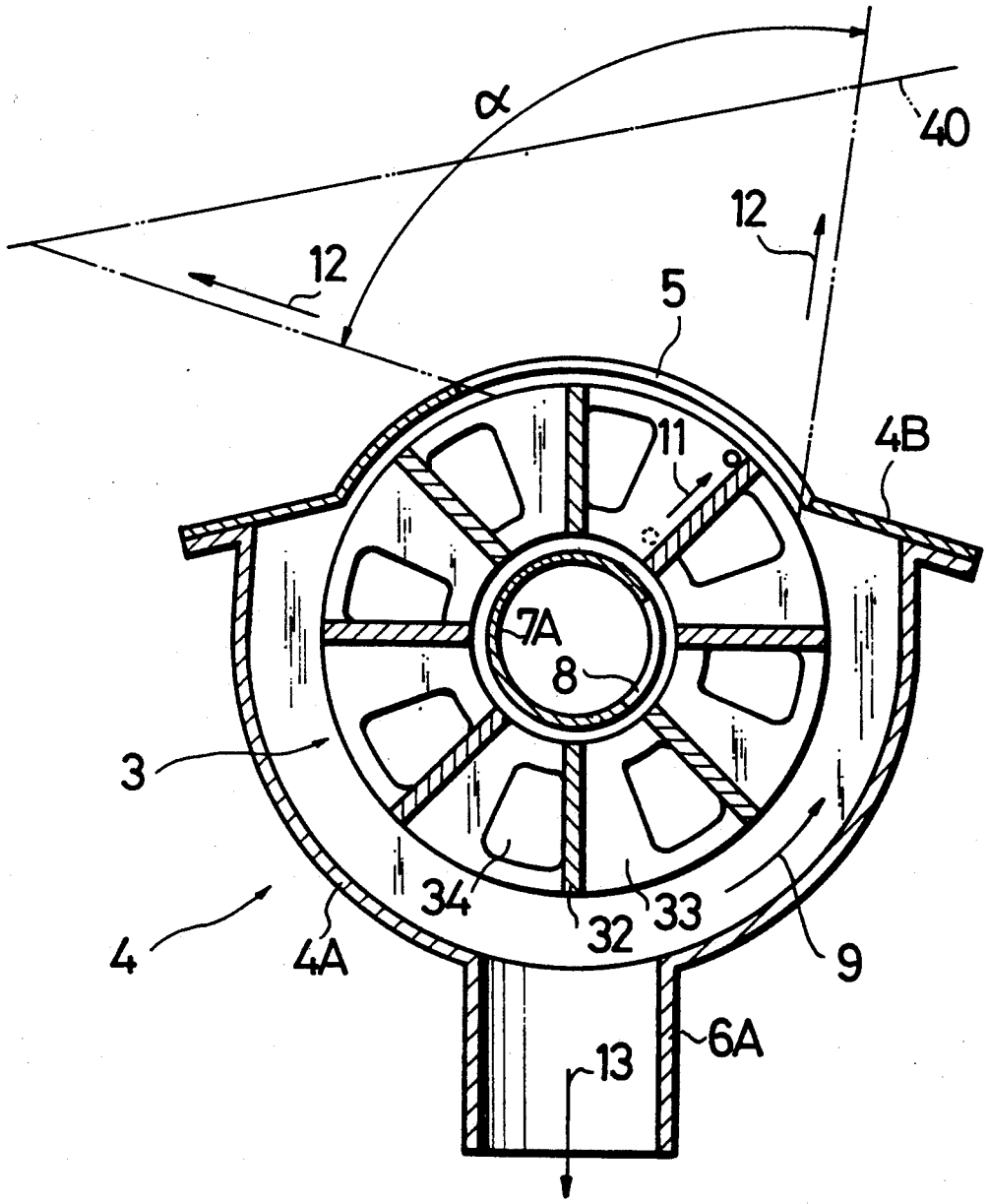
FIG. 4 is a cross section of the blasting head of FIG. 1 taken along the line 4—4 in FIG. 3.
Figure 5:
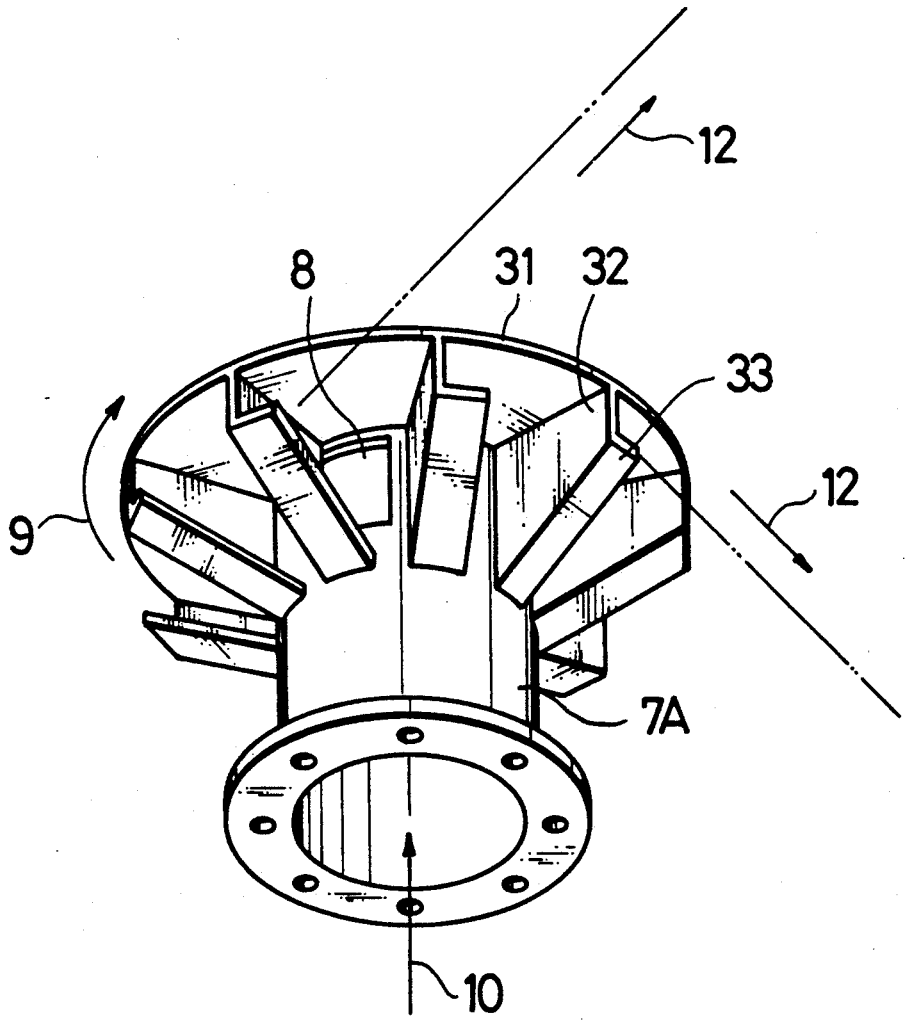
FIG. 5 is a perspective view of another rotary blade wheel and associated inlet suction conduit as seen from the upstream side of the inlet suction conduit.

Referring to FIGS. 3, 4 and 6, the operation of the centrifugal blasting apparatus of FIG. 6 is described below. Pulverized abrasive material flows down from the storage 20 via the control valve 21. It falls in the intermediate section 7B of the inlet suction conduit 7 with the gravity of force to ride on the carrier gas or air, which is drawn from the inside of the blasting cabinet 18, as indicated by arrows 13 and 14. Thus, the airborne pulverized abrasive material is drawn to the downstream end 7A of the inlet suction conduit 7, as indicated by arrow 10. Then, it flows out from the opening 8 of the downstream end 7A. Pulverized abrasive material is struck by the rotating blades 32 of the rotary wheel 3 to be thrown with the centrifugal force, passing through the slot 5 of the casing 4 and flying toward a selected surface 40 of an object to be treated by blasting.

After striking against the surface of the object pulverized abrasive material is prevented from scattering out of the blasting cabinet 18 by the rubber or brush seal 19, falling in the collector 20 by the force of gravity. Negative pressure is caused by suction of air from the inlet suction conduit 7B to the outlet suction conduit 6A and associated flexible tube 6B, and is applied to the blasting cabinet 18. Therefore, even if minute dust should appear in blasting the scattering of such dust out of the blasting cabinet can be prevented under the influence of such negative pressure.

Also, the negative pressure has the effect of pushing the blasting cabinet 18 against the surface of the object, and this is advantageous to the moving of the blasting assembly on the surface of the object while keeping it attached close to the surface. A vacuum destroying valve (not shown), however, may be provided to the blasting cabinet 18 to prevent increase of the negative pressure in the blasting cabinet 18 beyond a predetermined value by allowing invasion of air from the surrounding atmosphere.

After being separated from pulverized abrasive material in the wheel casing 4 the carrier air joins with the air flowing from the slot 5 to be drawn together in the outlet suction conduit 6A and associated flexible tube 6B by a vacuum pump or other air-suction means (not shown).

Referring to FIG. 7, the operation of the centrifugal blasting apparatus is described below. Pulverized abrasive material flows down from the collector 22 via the control valve 21, falling in the downstream section 7C of the inlet suction conduit with the gravity of force to ride on the carrier gas or air. The airborne pulverized abrasive material is drawn to the downstream end 7A of the inlet suction conduit via the downstream sections 7C and 7B, and then it flows out from the opening 8 of the downstream end 7A, as seen from FIG. 3. Pulverized abrasive material is struck by the rotating blades 32 of the rotary wheel 3 to be thrown with the centrifugal force, passing through the slot 5 of the casing 4 and flying toward a selected surface 40 of an object to be treated by blasting.

After striking against the surface of the object pulverized abrasive material is prevented from scattering out of the blasting cabinet 18 by the seal 19, thus falling in the upstream end 7F of the inlet suction conduit to be carried to the top of the collector 22 via the upstream section 7E of the inlet suction conduit. At the top of the collector 22 the carrier air is separated from pulverized abrasive material, allowing the separated abrasive material to fall down in the collector 22 and at the same time, the carrier air to flow to the downstream section 7C via the bypass section 7D as indicated by arrows 13, and again pulverized abrasive material rides on the air to be carried to the wheel casing 4, where the air is separated and drawn into the outlet suction conduit 6A and associated flexible tube 6B as indicated by arrow 13.

As is apparent from the above, a centrifugal blasting apparatus according to the present invention provides an elongated slot of wheel casing reduced in width and wide in length to permit pulverized abrasive material to pass therethrough, and therefore, it permits increase of blasting efficiency without using force of gravity to supply pulverized abrasive material to its rotary blade wheel, and simultaneously the positioning of the rotary blade wheel is not limited with regard to availableness of the force of gravity.

It requires neither air-tight ejector nor massive circulating means such as screw conveyers or bucket elevators for pulverized abrasive material, and accordingly its weight and size can be reduced substantially. It uses one and same suction means both to evacuate its blasting cabinet and transport and circulate pulverized abrasive material. Also, this permits substantial reduction of weight and size. The substantial reduction of weight and size thus attained makes the apparatus appropriate for attaching to a self-propelling robot.

I claim:

1. A centrifugal blasting apparatus for blast cleaning or shot peening treatment of a selected surface of an object to be treated by throwing pulverized abrasive material onto the surface, comprising:

a rotary blade wheel;

a wheel casing to enclose said rotary blade wheel, said wheel casing having defined therein an elongated slot to permit pulverized abrasive material to pass therethrough and scatter through air with centrifugal force;

an inlet suction conduit connected at a downstream end of said wheel casing to permit transportation of airborne pulverized abrasive material from an upperstream suction end to an inside of said wheel casing to said rotary blade wheel; and an outlet suction conduit connected at the upperstream end to said wheel casing and at the downstream end, said outlet suction conduit including suction means for drawing air from a side of said wheel casing.

2. A centrifugal blasting apparatus claimed in claim 1, wherein the downstream end of said inlet suction conduit is positioned at a center of said rotary blade wheel, and is provided with an opening at a side of said wheel casing in the vicinity of blade roots, which are fixed to a hub plate of said rotary blade wheel.

3. A centrifugal blasting apparatus claimed in claim 2, wherein said rotary blade wheel has a plurality of blades connected to the hub plate, each blade radially extending and formed so as to have a width of a surface of each blade converge outwardly away from the hub plate.

4. A centrifugal blasting apparatus claimed in claim 3, wherein the hub plate of said rotary blade wheel is integrally connected to an axle of said rotary blade wheel and formed so as to extend radially and incline down outward in a frusto conical surface, and the outward converging blades are integrally connected to the frusto conical hub plate.

5. A centrifugal blasting apparatus claimed in claim 4, wherein each blade includes a vertical piece integrally connected on an upper edge to the frusto conical hub plate and an outward rising sector piece integrally connected to a lower edge of the vertical piece and extending perpendicular thereto.

6. A centrifugal blasting apparatus claimed in claim 5, wherein the vertical piece is formed such that the upper edge and lower edge with the sector piece converge toward an outer periphery of said rotary blade wheel.

7. A centrifugal blasting apparatus claimed in claim 1, further comprising:

a blasting cabinet having defined therein an opening to be directed to the selected surface of an object to be treated by blasting, said blasting cabinet being integrally connected to said wheel casing with the elongated slot of said wheel casing being directed to the opening of said blasting cabinet, and the upperstream end of said inlet suction conduit being connected to said blasting cabinet so as to communicate with an inner space of said blasting cabinet.

8. A centrifugal blasting apparatus claimed in claim 7, further comprising:

an abrasive material storage connected to a bottom of said blasting cabinet and to said inlet suction conduit intermediate between upstream and downstream ends thereof.

9. A centrifugal blasting apparatus claimed in claim 8, wherein said abrasive material storage includes a flow control valve means for controlling a flow rate of pulverized abrasive material from said abrasive material storage.

10. A centrifugal blasting apparatus claimed in claim 7, further comprising:

an intermediate length of said inlet suction conduit connected between an abrasive material collector and a downstream length of said inlet suction conduit.

11. A centrifugal blasting apparatus claimed in claim 10, wherein an upperstream length of said inlet suction conduit is connected at the upperstream end of said inlet suction conduit to said blasting cabinet, and at a downstream end of said upperstream length to a top of said abrasive material collector, said intermediate length of said inlet suction conduit is connected at an upperstream end to the top of said abrasive material collector, and at a downstream end to a bottom of said abrasive material collector, and the downstream length of said inlet suction conduit is connected at an upperstream end to the bottom of the abrasive material collector, and at a downstream end to a bottom of said wheel casing.

12. A centrifugal blasting apparatus claimed in claim 11, wherein said abrasive material collector includes a flow control valve means for controlling a flow rate of pulverized abrasive material from said abrasive material collector.

13. A centrifugal blasting apparatus claimed in claim 7, wherein said blasting cabinet includes seal means around an opening thereof, for preventing scattering of pulverized abrasive material from said blasting cabinet.

* * * * *

UNITED STATES PATENT AND TRADEMARK OFFICE

CERTIFICATE OF CORRECTION

PATENT NO. : 5,205,085

DATED : April 27, 1993

INVENTOR(S) : Fukashi URAKAMI

It is certified that error appears in the above-identified patent and that said Letters Patent is hereby corrected as shown below:

On the title page, after Item [22], the following should appear:

item [30] Foreign Application Priority Data

May 24, 1991 [JP] Japan ..... 3-222539 --.

Signed and Sealed this

Thirtieth Day of November, 1993

*Attest:*

BRUCE LEHMAN

*Attesting Officer*

*Commissioner of Patents and Trademarks*